US008596253B2

(12) United States Patent
Adams

(10) Patent No.: US 8,596,253 B2
(45) Date of Patent: Dec. 3, 2013

(54) ROTATING ARROW REST

(75) Inventor: Brian J. Adams, Vincennes, IN (US)

(73) Assignee: Bear Archery, Inc., Evansville, IN (US)

( * ) Notice: Subject to any disclaimer, the term of this patent is extended or adjusted under 35 U.S.C. 154(b) by 252 days.

(21) Appl. No.: 13/101,545

(22) Filed: May 5, 2011

(65) Prior Publication Data

US 2012/0285432 A1 Nov. 15, 2012

Related U.S. Application Data

(60) Provisional application No. 61/387,210, filed on Sep. 28, 2010.

(51) Int. Cl.
*F41B 5/22* (2006.01)

(52) U.S. Cl.
USPC ..... 124/44.5

(58) Field of Classification Search
USPC ..... 124/24.1, 44.5
See application file for complete search history.

(56) References Cited

U.S. PATENT DOCUMENTS

| | | | | |
|---|---|---|---|---|
| 4,287,868 | A * | 9/1981 | Schiff | 124/44.5 |
| 5,368,006 | A | 11/1994 | McPherson | |
| 5,482,025 | A | 1/1996 | Finkel | |
| 5,490,492 | A * | 2/1996 | Savage | 124/44.5 |
| 5,632,263 | A * | 5/1997 | Sartain | 124/44.5 |
| 5,697,356 | A | 12/1997 | Chappell | |
| 5,722,381 | A | 3/1998 | Mizek | |
| 6,044,832 | A | 4/2000 | Piersons, Jr. | |
| 6,202,635 | B1 * | 3/2001 | Evans | 124/44.5 |
| 6,561,174 | B1 | 5/2003 | Afshari | |
| 6,595,195 | B1 | 7/2003 | Barner et al. | |
| 6,615,813 | B1 | 9/2003 | Troncoso, Jr. et al. | |
| 6,634,349 | B2 | 10/2003 | Mizek et al. | |
| 6,681,753 | B2 | 1/2004 | Afshari | |
| 6,681,754 | B1 | 1/2004 | Angeloni | |
| 6,739,321 | B1 | 5/2004 | Puchlerz | |
| 6,782,881 | B2 | 8/2004 | Mizek et al. | |
| 6,789,536 | B1 | 9/2004 | Summers | |
| 7,021,301 | B2 | 4/2006 | Nagle | |
| 7,311,099 | B2 | 12/2007 | Rager | |
| 7,409,950 | B2 | 8/2008 | Ellig et al. | |
| 7,597,095 | B2 * | 10/2009 | Grace et al. | 124/44.5 |
| 2006/0157038 | A1 | 7/2006 | Ellig | |
| 2006/0162709 | A1 * | 7/2006 | Roberts et al. | 124/44.5 |
| 2011/0139137 | A1 * | 6/2011 | Simo et al. | 124/44.5 |

OTHER PUBLICATIONS

International Patent Application PCT/US2011/049777 Search Report and Written Opinion mailed Apr. 23, 2012.

* cited by examiner

*Primary Examiner* — John Ricci
(74) *Attorney, Agent, or Firm* — Woodard, Emhardt, Moriarty, McNett & Henry LLP

(57) ABSTRACT

Arrow rest arrangements according to certain embodiments include an elongate arm mounted to extend into and rotate in the plane of an arrow aligned with an archery bow and riser. The arm can rotate from an open position, for example where the arm is substantially perpendicular to the arrow shaft, to a closed position where the arm engages and may be substantially aligned with the arrow shaft. The arm preferably includes two opposing end portions to engage, constrain and align the arrow shaft in the closed position, yet which drop or rotate away from the shaft upon release of the arrow to allow the arrow to freely leave the bow.

19 Claims, 13 Drawing Sheets

ROTATING ARROW REST

This application claims the benefit of U.S. Provisional Patent Application No. 61/387,210, filed Sep. 28, 2010, which is hereby incorporated by reference in its entirety.

FIELD OF THE INVENTION

Aspects of the present invention deal with archery bows, and in particular deal with accessories such as arrow rests usable with archery bows.

BACKGROUND OF THE INVENTION

Arrow rests can be used with archery bows, including compound or recurve bows, to support and preferably stabilize an arrow shaft in position to allow the shaft to be drawn and released from an archery bow, preferably without substantial deviation from the desired flight path. The arrow rest preferably aligns an elongate axis of the arrow shaft in a desired path which the arrow follows during release from the bow and at least initially towards the target. Various types of arrow rests are known. An example of a vertical drop away arrow rest is illustrated in U.S. Pat. No. 7,311,099.

SUMMARY

Arrow rest arrangements according to certain preferred embodiments described herein include an elongate arm mounted to extend into and rotate in the plane of an arrow aligned with an archery bow and riser. The arm can rotate from an open position, for example where the arm is substantially perpendicular to the arrow shaft, to a closed position where the arm engages and may be substantially aligned with the arrow shaft. The arm preferably includes two opposing end portions to engage, constrain and align the arrow shaft in the closed position, yet which drop or rotate away from the shaft upon release of the arrow to allow the arrow to freely leave the bow.

In certain embodiments, an arrow rest for an archery bow includes a base securable to an archery bow and an arm having a middle portion rotatably mounted to the base. The arm includes two opposing end portions wherein the end portions are aligned to define a path arranged to releasably grasp the diameter of an arrow shaft. Additionally, the arm is rotatable from an open position where the path is substantially perpendicular to the axis of the arrow shaft to a closed position wherein the end portions engage the arrow shaft.

In further embodiments, an arrow rest for supporting an arrow shaft on an archery bow comprises a base securable to an archery bow and an arm having a middle portion rotatably mounted to the base and two opposing end portions spaced apart along the length of the arm. The arm is rotatable from an open position wherein the opposing end portions are disengaged from an arrow shaft, to a closed position. The end portions engage and support the arrow shaft in a desired shooting alignment. The end portions are rotatable in a plane containing the axis of the supported arrow shaft. Opposing end portions each define an open profile, wherein the profiles engage the arrow shaft with the end portions arranged on opposing sides of the arrow shaft and a cocking mechanism which retains the arrow rest in the closed position prior to a full draw of the bow.

In still further embodiments, an arrow rest for supporting an arrow shaft on an archery bow consists of a base securable to an archery bow as well as an arm for supporting an arrow shaft with a diameter and an elongate axis. The arm has a middle portion which is rotatably mounted to the base and two opposing end portions are spaced apart along the length of the arm. Further, the arm has a rotational axis aligned perpendicular to the axis of the arrow shaft. The opposing end portions are aligned to define a path arranged to releasably grasp the diameter of an arrow shaft with the end portions. The arm is rotatable from an open position having opposing end portions which are disengaged from the arrow shaft to a closed position wherein the end portions engage the arrow shaft.

Additional objects and advantages of the described embodiments are apparent from the discussions and drawings herein.

DESCRIPTION OF SPECIFIC EMBODIMENTS

Figure 1:
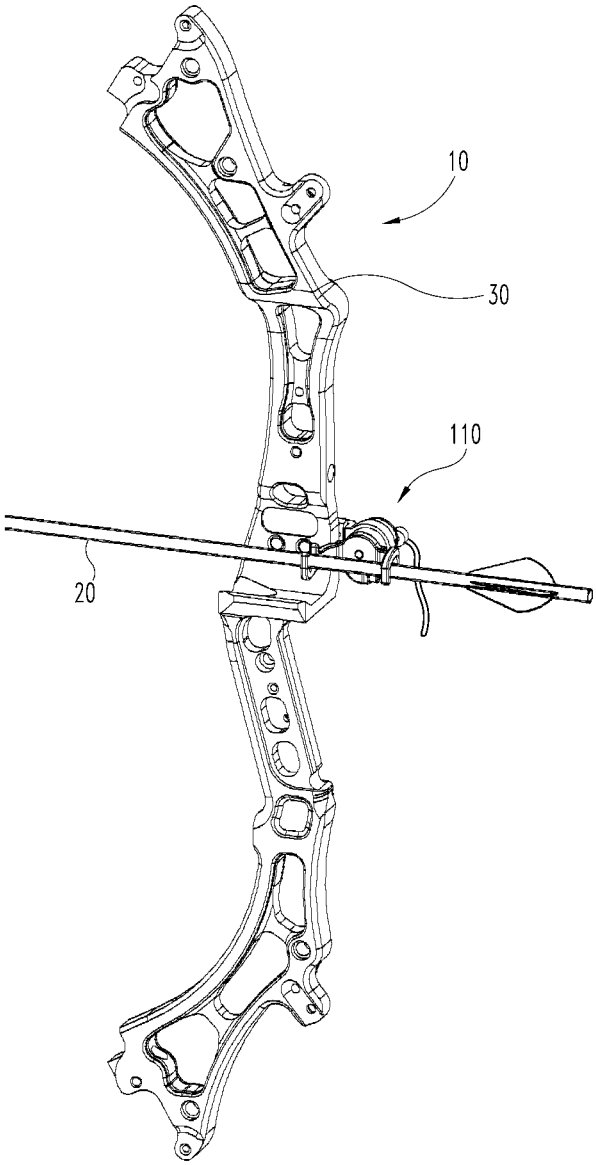
FIG. 1 is a perspective view of an embodiment of the present disclosure mounted on an archery bow riser and engaged with an arrow.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Arrow rest arrangements according to certain preferred embodiments described herein include an elongate arm mounted to extend into and rotate in the plane of an arrow aligned with an archery bow and riser. The arm can rotate from an open position, for example where the arm is substantially perpendicular to the arrow shaft, to a closed position where the arm engages and may be substantially aligned with the arrow shaft. The arm preferably includes two opposing end portions to engage, constrain and align the arrow shaft in the closed position, yet which drop or rotate away from the shaft upon release of the arrow to allow the arrow to freely leave the bow.

Certain embodiments of the arrow rest include a cocking arrangement which allows the arrow rest to be closed to retain the arrow while the bow is in a brace or less than fully drawn position; however, upon achieving full draw, the cocking mechanism is disengaged and allows the arrow rest to rotate away upon a full speed release of the bowstring and arrow. In certain embodiments, the cocking mechanism re-engages upon a slow release or let-down of the bowstring by the archer.

An archery bow 10 is partially illustrated in FIG. 1 with riser 30. When viewed from the perspective of an archer holding the bow, a typical bow 10 includes a riser 30 with a handle, an upper limb portion and a lower limb portion (not shown). Rotational members forming one or two variable leverage units such as an idler wheel and an eccentric cam are supported at the limb tip sections for rotary movement about axles. The idler wheel is carried between the outer limb tip portions of the upper limb. The cam is carried between the outer limb tip portions of the lower limb.

A bowstring and cabling (not shown for convenient illustration of the rest) includes an upper end and a lower end which are fed-out from the idler wheel and cam when the bow is drawn. Return cables often extend between the respective tips and or cams. The bowstring is mounted around the idler wheel and cam as is known in the art. From the perspective of the archer, the bowstring is considered rearward relative to the riser which defines forward.

When the bowstring is drawn, it causes the the idler wheel and cam at each end of the bow to rotate, feeding out cable on the bowstring side and at least partially taking up the return cables, correspondingly bending the limb portions inward, causing energy to be stored therein. When the bowstring is released with an arrow engaged to the bowstring, the limb portions return to their rest position, causing idler wheel and cam to rotate in the opposite direction, taking up the bowstring and return cables and launching the arrow with an amount of energy proportional to the energy stored in the bow limbs. Bow 10 is described for illustration and context and is not intended to be limiting. The present invention can be used with dual-cam compound bows, or can be used with single-cam bows as described for example in U.S. Pat. No. 5,368,006 to McPherson, hereby incorporated herein by reference. It can also be used with hybrid cam bows or recurve bows. The present invention can also be used in other types of bows, which are considered conventional for purposes of the present invention. Arrow 20 including a shaft and fletchings is shown for illustration in FIG. 1.

Figure 2:
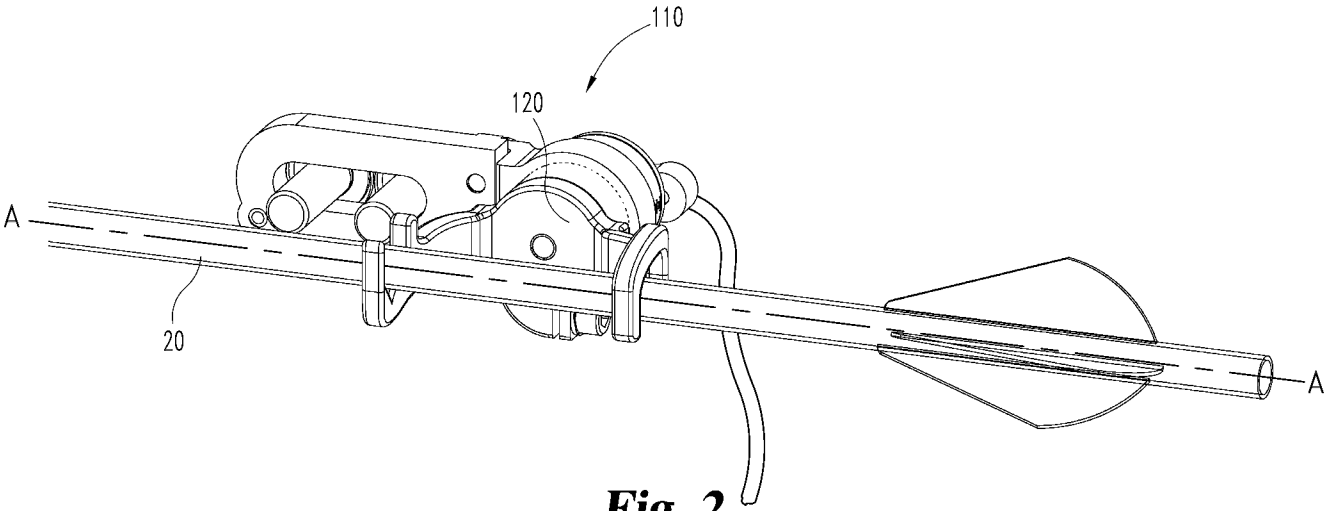
FIG. 2 is a perspective view of an arrow rest according to a preferred embodiment in a closed position with an arrow.
Figure 3:
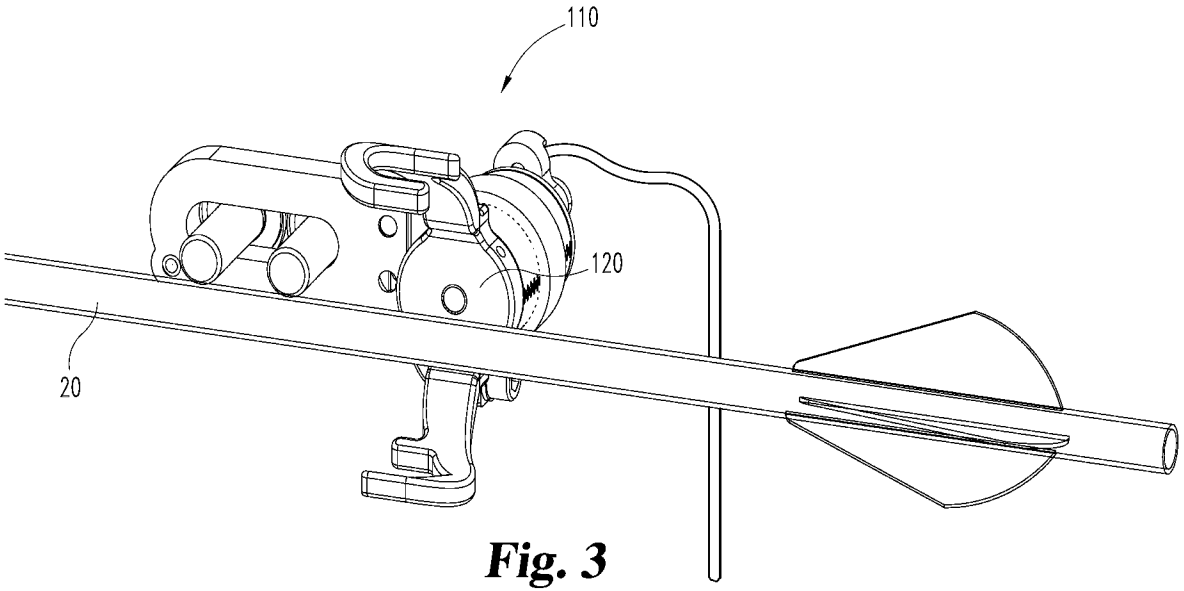
FIG. 3 is a perspective view of the embodiment of FIG. 2 in the open position.
Figure 4:
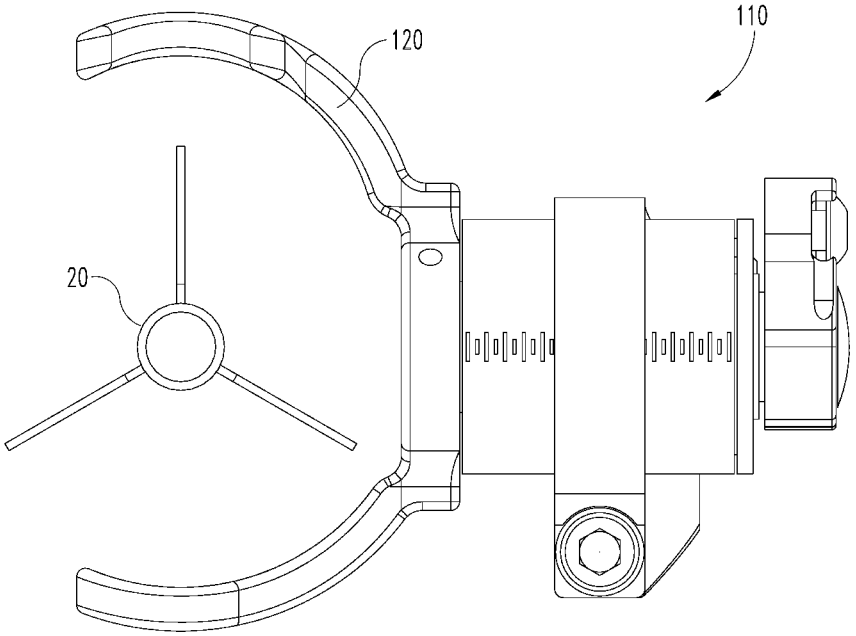
FIG. 4 is a rear view of the embodiment of FIG. 3.

FIG. 2 illustrates arrow 20 engaged with arm 120 of rest 110 in a closed position. Arrow 20 includes a length which defines an elongate axis A-A. FIG. 3 illustrates arrow 130 adjacent to but disengaged from arm 120 in an open position, as would occur immediately after a full speed or shooting release of the bowstring and arrow from full draw. A rear view of the arrow 20 and rest 110 immediately after release, as shown in FIG. 4, illustrates that upon disengagement of arm 120, there is preferably sufficient clearance around the shaft and fletchings of arrow 20 to allow the arrow and fletchings to pass rest 110 and to freely proceed from the bow towards the target.

Figure 5:
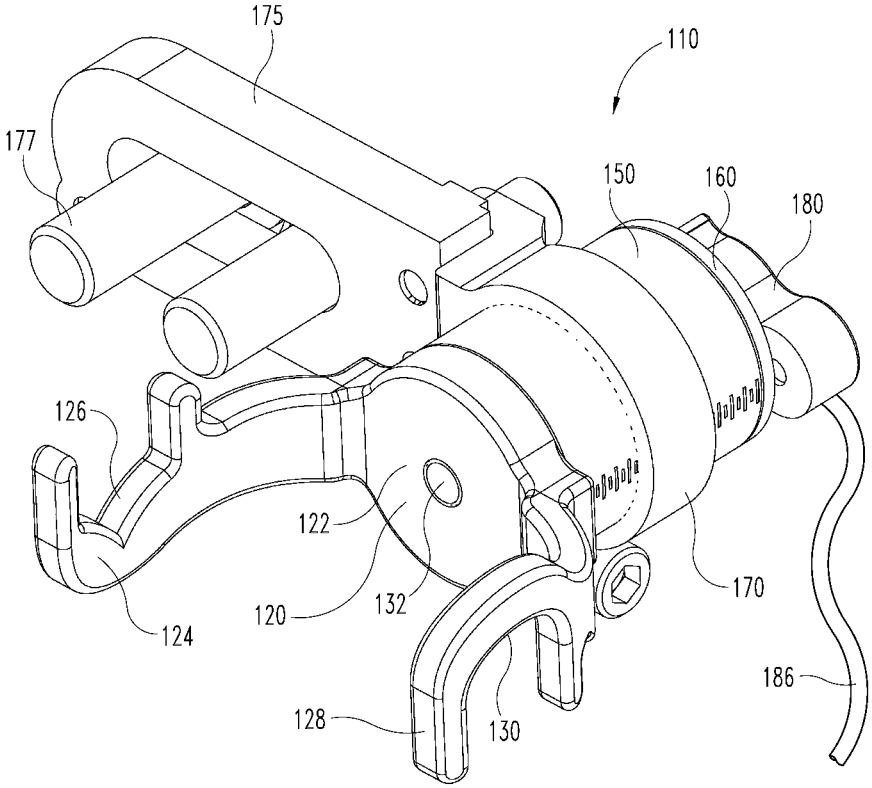
FIG. 5 and FIG. 6 are perspective views of an embodiment of the arrow rest in a closed position.
Figure 6:
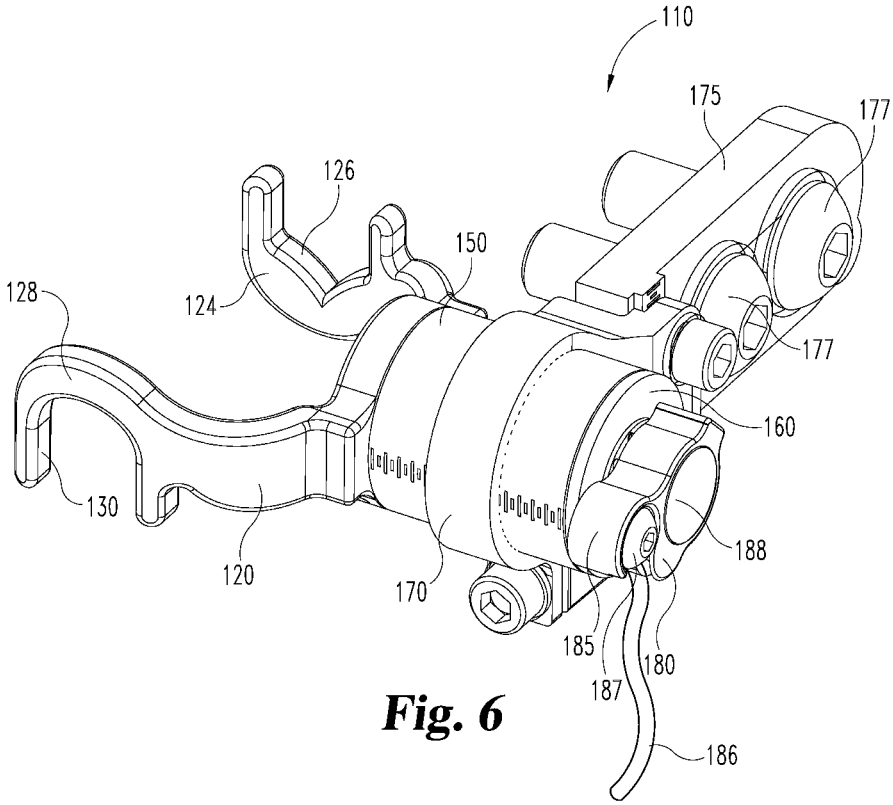
Figure 7:
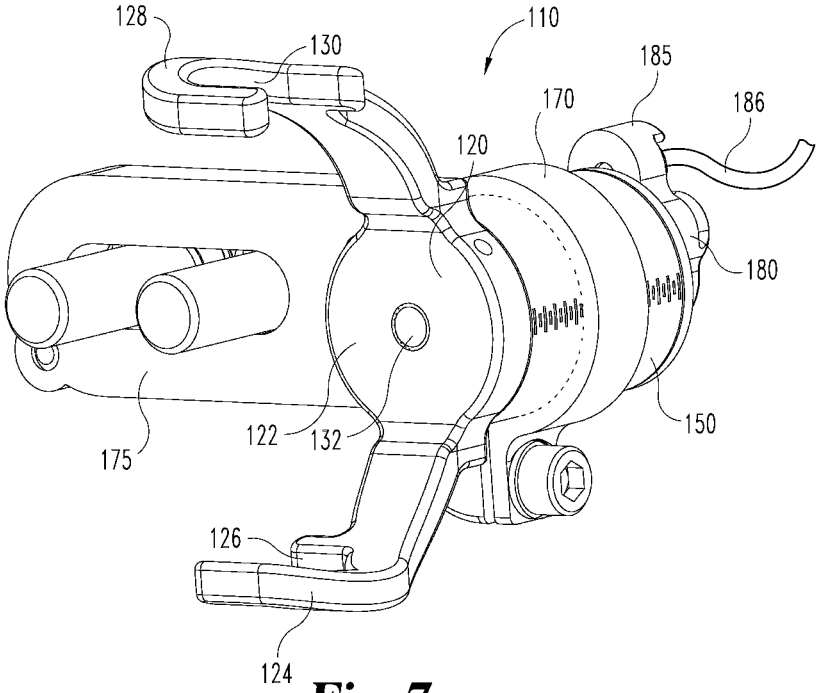
FIG. 7 is a perspective view of an embodiment of the arrow rest of FIG. 5 and FIG. 6 in an open position.

FIG. 5 and FIG. 6 illustrate perspective views of arrow rest 110 in a closed or cocked position, with FIG. 7 illustrating arrow rest 110 in an open position. Rest 110 includes arrow support arm 120 which is rotationally or pivotally mounted to a base, such as barrel assembly 150, which in turn is secured to riser 30 of archery bow 10. Arm 120 preferably includes a middle section 122, a forward end 124 and a rearward end 128. References to rearward and forward herein are from the perspective of an archer using a bow and are used for convenience of illustration while not intended to be limiting.

In certain embodiments, the opposing end portions are arranged on opposite sides of the arrow shaft. As a non-limiting example, a forward one of the opposing end portions is arranged below the shaft while a rearward one of the opposing ends portions is arranged above the shaft. In some embodiments, the opposing end portions are rotatable in a plane containing the axis of the arrow shaft. In the illustrated embodiment, the opposing end portions engage the arrow shaft at a pair of spaced apart points along the length of the arrow shaft.

The forward end 124 of arm 120 includes a forward shaft engagement portion 126 with an upwardly open U or V shaped profile or the like sized and shaped to surround and hold an arrow shaft and to center it upon forward end 124. A rearward end 128 of arm 120 includes a rearward shaft engagement portion 130. Rearward shaft engagement portion 130 preferably includes a downward opening U or V shaped profile or the like also sized and shaped to at least partially encircle and limit movement of the arrow shaft within rearward end 128. For example, at least one and optionally both profiles may each encircle at least 180 degrees of the circumference of the arrow shaft and extend past a center diameter of the shaft. In the illustrated embodiment, the combined profiles provide at least 360 degrees of encirclement. Optionally, one or both profiles can encircle less than 180 degrees of the circumference of the shaft.

Preferably forward shaft engagement portion 126 and rearward shaft engagement portion 130 are aligned to define a path, with the profiles overlapping yet allowing sufficient clearance to support the diameter of a straight arrow shaft extending through both ends. The profiles preferably urge the shaft to be in a desired horizontal and vertical alignment at full draw of the bow. For example, the engagement of two profiles each extending past opposing horizontal sides of the shaft at two spaced apart points, substantially eliminates horizontal shifting or torque of the arrow shaft relative to the riser.

The profile of rearward end 128 is optionally slightly larger than the diameter of the arrow shaft so that the profile does not touch the shaft in its preferred alignment. In certain embodiments, the arrow shaft passes between the legs of the profile defined by the rearward end portion, but in normal use the arrow shaft does not contact the rearward end portion unless the arrow is not in the desired alignment. In certain non-contact embodiments, the rearward end portion functions primarily as a guard to prevent an arrow shaft from moving too far away from a desired alignment.

The middle section 122 of arm 120 is secured to one end of rotatable axle 132 which extends into barrel assembly 150. Axle 132 extends through barrel assembly 150, with the axle secured at its opposing end to a rope arm 180. Barrel assembly 150 is held by a barrel clamp 170 which is engaged to mounting bracket 175 which is configured to be secured to an archery bow riser, for example with cap screws 177. Optionally, barrel clamp 170 is adjustably mounted to mounting bracket 175 to be secured at a selected height by an archer.

Rope arm 180 is secured to rotate with the outer end of axle 132. An optional cover 188 may enclose the end of the axle and may be decorated with indicia such as a logo if desired. Rope arm 180 includes a lever arm portion 185. A cord 186, rope, cable or similar pulling piece can be secured at one end to lever arm portion 185, for example with screw 187. The opposing end of the cord 186, rope or cable can be secured to a selected point on the cabling arrangement of the bow, for example to the bowstring, a return cable or a movable cable guard. The connection point of cord 186 or similar piece to the cabling arrangement is preferably selected so that during the final portion of a full draw the cord pulls upon lever arm portion 185 to rotate rope arm 180 and correspondingly axle 132 and arm 120 to a slightly overdrawn position, discussed hereafter.

Figure 8:
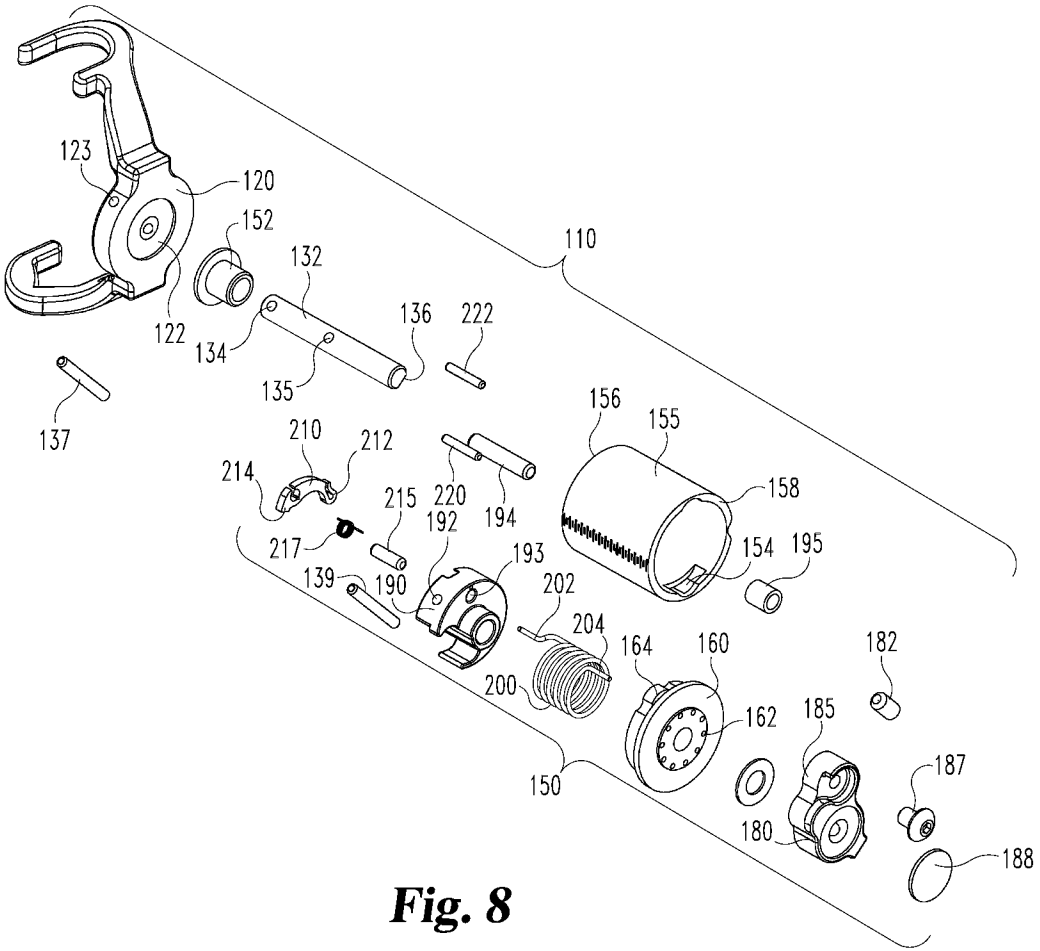
FIG. 8 is an exploded view of the embodiment illustrated in FIG. 5, FIG. 6 and FIG. 7.

An exploded view of arrow rest 110 and barrel assembly 150 is illustrated in FIG. 8. An inner or support arm end of axle 132 preferably extends into an axial passage defined in middle section 122 of arm 120. An axle securing pin 137 extends perpendicularly to the axle through an axle pin passage 123 in arm 120 and through axle pin passage 134 in axle 132 to secure arm 120 in a fixed angular relationship relative to axle 132. The portion of axle 132 outward of arm 120 then extends through axle bushing 152 into barrel assembly 150 and its internal mechanisms, and outward of barrel 150 so that an outward end of the axle is arranged to connect to rope arm 180. Rope arm 180 is secured at a fixed angular relationship to axle 136, for example using a cup ended set screw 182 advanced against a flat portion 136 of axle 132.

Barrel 155 includes a closed forward end 156, a generally cylindrical inner volume and an open outward end 158. Within the barrel assembly 150, axle 132 centrally extends through dog leg carriage 190, torsion spring 200 and spring lock 160. Spring lock 160 is preferably formed to close and lock the open end 158 of barrel 155 and to apply a preload to spring 200, for example with tabs 164 of spring lock 160 engaging grooves 154 of barrel 155.

Dog leg carriage 190 is mounted to axle 132 and rotatable within barrel 155. Dog leg carriage 190 is preferably mounted at a fixed angular relationship to axle 132 via locking pin 139 which extends perpendicular to axle 132 through locking passage 192 in dog leg carriage 190 and through locking pin passage 135 in axle 132. An inward end 202 of torsion spring 200 engages spring hole 193 on dog leg carriage 190 while an outward end 204 of spring 200 engages a spring mounting hole 162 of spring lock 160. Preferably when assembled, spring 200 is compressed between dog leg carriage 190 and spring lock 160.

Dog leg 210 is pivotally mounted to the forward face of dog leg carriage 190 via pivot pin 215. Dog leg 210 forms a bell crank structure including a locking end with a spring clip portion 212 and an opposing stop end 214. Dog leg spring 217 is preferably mounted around pivot pin 215 between dog leg 210 and dog leg carriage 190. Dog leg spring 217 preferably includes a dog leg end and a carriage end secured in respective portions, such as slots in dog leg 210 and carriage 190 to assert a biasing force on dog leg 210. Preferably, spring 217 is biased to apply a rotational force on dog leg 210 around pivot pin 215, biasing locking end 212 radially outward relative to axle 132.

Figure 9:
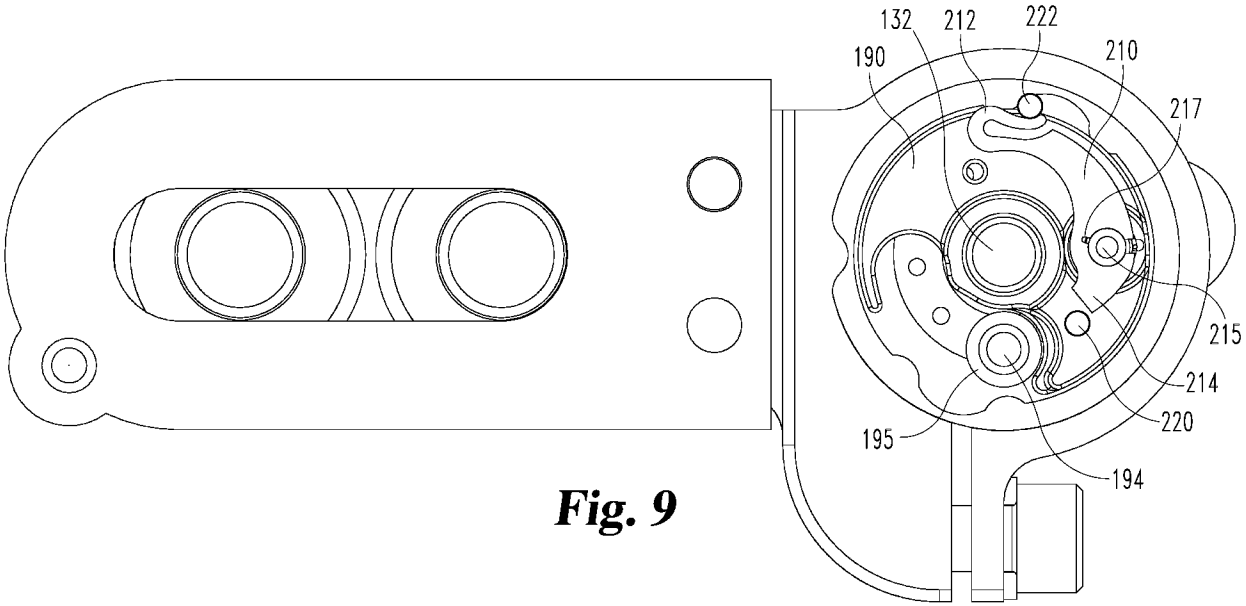
FIG. 9 is an internal view of the embodiment of FIG. 8 from the perspective of the arrow rest arm corresponding to the rest arm being positioned in a closed position.
Figure 10:
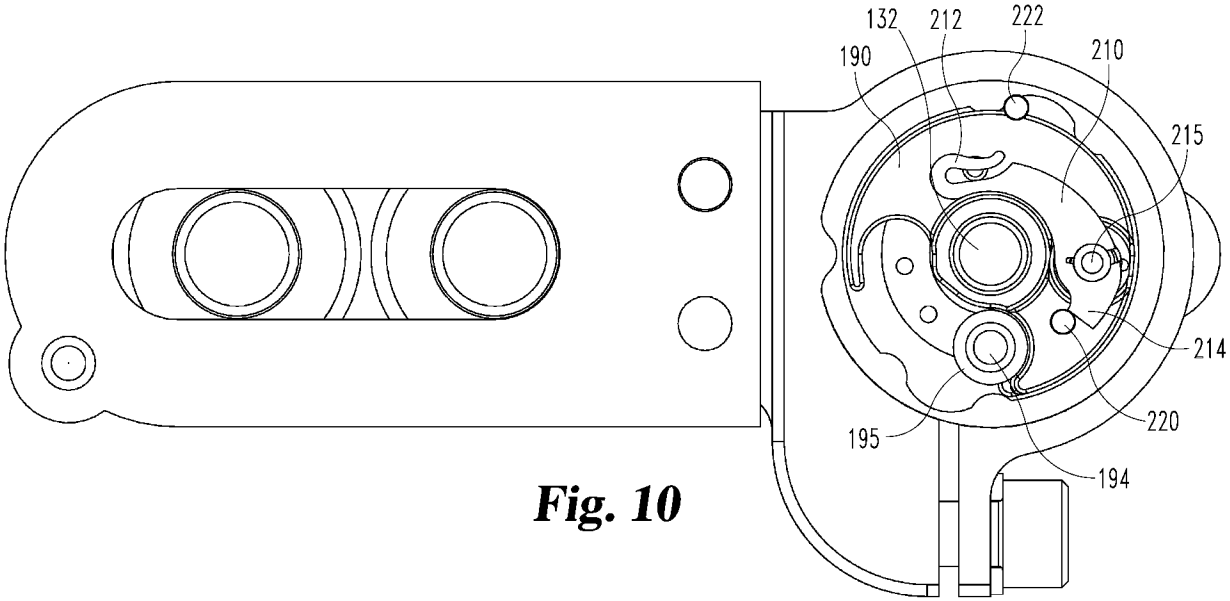
FIG. 10 is an internal view of the embodiment of FIG. 9 corresponding to the rest arm in a position occurring upon full draw of the bow.
Figure 11:
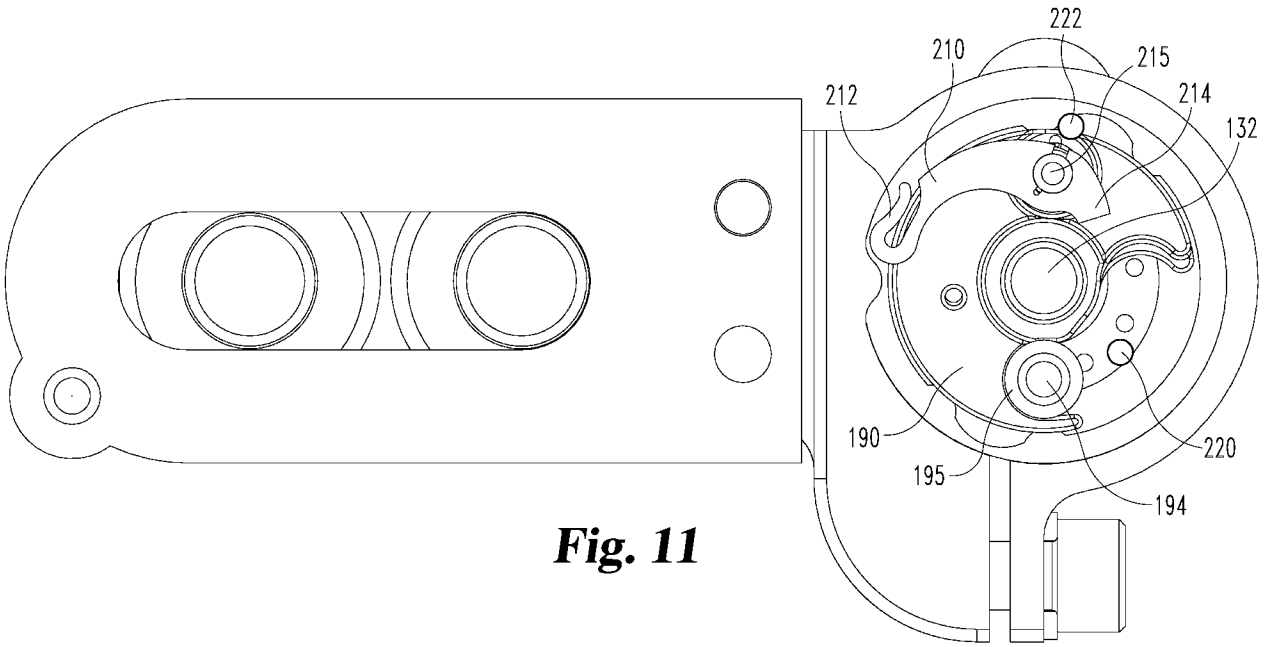
FIG. 11 is an internal view of the embodiment of FIG. 9 corresponding to the rest arm in an open position occurring upon release of the bowstring.

FIGS. 9, 10 and 11 illustrate internal views of barrel assembly 150 in different positions as seen from the perspective of the support arm looking outward. The support arm 120, axle securing pin 137, axle bushing 152, and barrel 155 are not shown to assist in viewing the internal assembly. FIG. 9 corresponds to a first closed or cocked position of arm 120, FIG. 10 corresponds to a second closed or overdrawn position at full draw of the bow, and FIG. 11 corresponds to the open or released position of the arm.

Dog leg carriage 190 is arranged to rotate with axle 132 within the internal circumference of barrel 155. Stop pin 194 is secured to the inward end of barrel 155 (not shown) and extends outward to provide a stop, limiting rotational movement of dog leg carriage 190. Dog leg carriage 190 may include arcuately shaped ends which respectively engage stop pin 194 providing limits to the rotational movement of carriage 190. Optionally, a dampening piece such as tube 195 may be mounted around pin 194 adjacent the stop positions to dampen vibration and noise as the dog leg carriage engages the stop. The dampening piece can be made from a suitable soft and/or flexible material such as rubber, nylon, or felt.

In the closed or cocked position illustrated in FIG. 9, dog leg carriage 190 is in a position where the support arm and axle have been turned to a closed position against the biasing force of torsion spring 200, and dog leg spring 217 has urged the locking end 212 of the dog leg to engage a cocking pin 222 within the barrel. Cocking pin 222 is secured to the inward end of barrel 155. Preferably, locking end 212 includes a spring clip portion which rests against cocking pin 222 to prevent undesired disengagement of the dog leg and correspondingly prevents torsion spring 200 from rotating the axle and arrow arm to an open position. In this position, the clockwise end of dog leg carriage 195 approaches, but has not yet reached stop 194.

When an archer draws the bow to a fully drawn position for intended release, rope arm 180 is pulled clockwise from the perspective of FIG. 10, translating dog leg carriage 190 and correspondingly dog leg 210 further clockwise so that stop end 214 of the dog leg presses against stop pin 220. The pressure of stop pin 220 against stop end 214 causes dog leg 210 to rotate counter-clockwise around pivot pin 215 against the biasing force of dog leg spring 217. This translational and pivotal movement disengages and moves locking end 212 out of alignment from cocking pin 222.

Upon a shooting release of the bowstring, torsion spring 200 causes dog leg carriage 190 to rotate counterclockwise at a sufficiently high speed that locking end 212 of dog leg 210 is rotated counterclockwise past cocking pin 222 before there is sufficient reaction time to reengage and recock the rest. Dog leg carriage 190 and dog leg 210 may continue pivoting counterclockwise within barrel 150 until the counterclockwise end of dog leg carriage 190 engages stop pin 194, as shown in FIG. 11.

Figure 12:
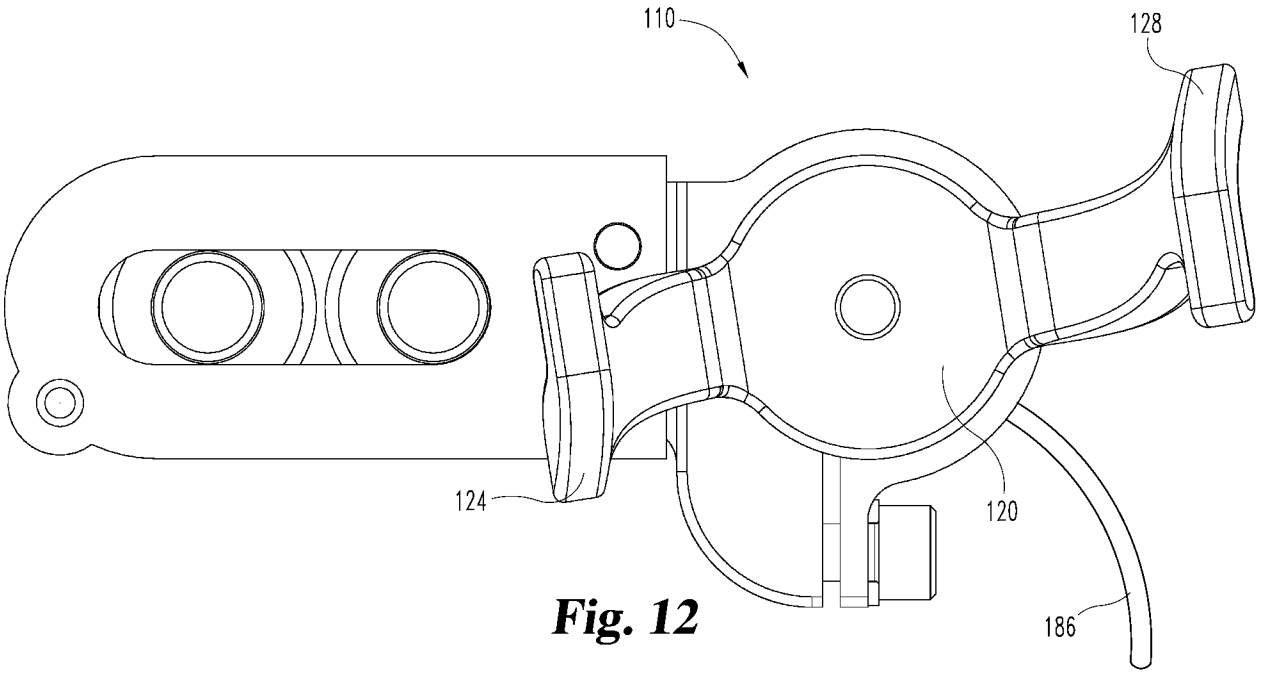
FIG. 12 is a side view of the embodiment of FIG. 8 with the arrow rest arm in the closed position.
Figure 13:
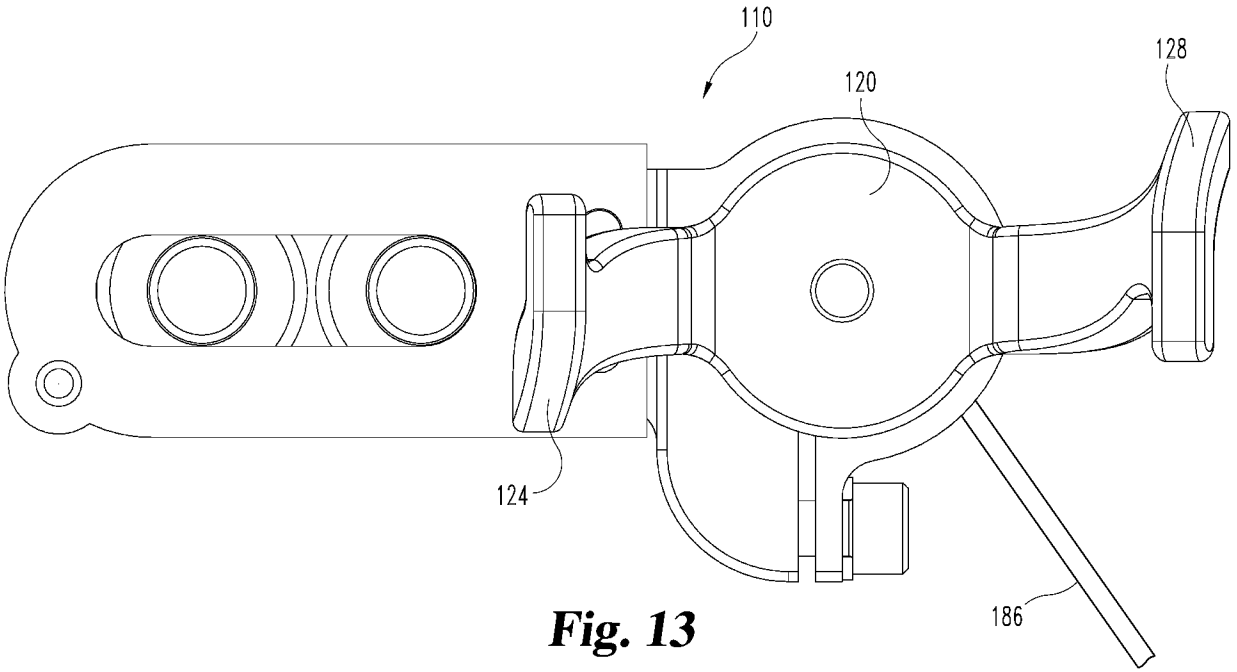
FIG. 13 is a side view of the embodiment of FIG. 8 with the arrow rest arm in the fully drawn position.

The cocked or closed position of the rest and arm 120 corresponding to the internal position illustrated in FIG. 9 is illustrated in FIG. 12. FIG. 13 illustrates the position arm 120 is in when the bow is at the fully drawn position, corresponding to the position of the internal mechanism illustrated in FIG. 10.

In preparing to shoot, an archer first places an arrow in the approximate position adjacent and extending past middle portion 122 and between the opposing ends of arm 120 in its open position. The arm is then manually rotated clockwise to a first closed or cocked position illustrated in FIG. 12. This rotation may be approximately 90 degrees or less. This rotation causes arm 120 to lift and constrain the arrow shaft in a position through the aligned open end portions of the arm. The archer may align the nock of the arrow with the bowstring before or after manually aligning it with the rest. While constrained in the rest, the arrow may be spun or moved forward or rearward along its axis A-A for adjustment and/or during partial draws of the bow.

When the archer is prepared to release the arrow, the bowstring and thus the bow is pulled to a fully drawn position, which correspondingly pulls cord 186 which pulls rope arm 180 clockwise. This clockwise pull correspondingly pulls the internal mechanism to an overdrawn position, disengaging dog leg 190 from locking pin 222 and, to the extent not already rotated to a desired position, further correspondingly rotates arm 120 to a second closed or fully drawn position illustrated in FIG. 12. Upon a shooting release of the bowstring and arrow, torsion spring 200 rotates the internal assembly and correspondingly arm 120 to the open position moving the opposing ends away from the arrow shaft, allowing the arrow to fly freely past the rest as illustrated in FIG. 4. The rest then remains in the open position until arm 120 is manually rotated to engage the next arrow to be shot. In an alternative to a shooting release, if the archer releases or lets-down from a full draw slowly, locking end 212 of dog leg 210 has sufficient time to react and re-engage cocking pin 222 to correspondingly hold the arrow support arm in the first closed, cocked position.

While the invention has been illustrated and described in detail in the drawings and foregoing description, the same is to be considered as illustrative and not restrictive in character, it being understood that only the preferred embodiment has been shown and described and that all equivalents, changes, and modifications that come within the spirit of the inventions as described herein and/or by the following claims are desired to be protected.

What is claimed is:

1. An arrow rest for an archery bow, comprising:

a base securable to an archery bow;

an arm having a middle portion rotatably mounted to said base;

said arm including two opposing end portions wherein said end portions are aligned to define a path arranged to releasably grasp the diameter of an arrow shaft;

wherein said arm is rotatable from an open position where the path is substantially perpendicular to the axis of the arrow shaft to a closed position wherein said path is substantially aligned with the arrow shaft, wherein when said arm is in said closed position a forward one of the opposing end portions is arranged below the shaft while a rearward one of the opposing ends portions is arranged above the shaft; and wherein said arrow rest comprises a cocking mechanism which allows the arrow rest to be rotated to a non-horizontal closed position prior to a full draw of the bow and which retains the arm in a closed position while the bow is in a brace or less than fully drawn position.

2. The arrow rest of claim 1, wherein the cocking mechanism is disengaged upon a full draw of the archery bow and wherein said opposing end portions of said arm are biased to rotate away from the arrow shaft upon a full speed release of the bow from a full draw.

3. The arrow rest of claim 2, wherein said the cocking mechanism engages upon a let-down of the bow from a full draw at substantially less than full speed.

4. The arrow rest of claim 2, comprising a cord extendable between said arrow rest and a cabling arrangement on the bow, wherein upon a full draw of the bow the cord is pulled by the cabling arrangement and causes said arm to rotate from said non-horizontal closed position to a horizontal fully drawn position.

5. The arrow rest of claim 2, comprising a cord extendable between said arrow rest and a cabling arrangement on the bow, wherein upon a full draw of the bow the cord is pulled by said cabling arrangement and causes said cocking mechanism to disengage.

6. The arrow rest of claim 1, wherein each of said opposing end portions defines an open profile to constrain an arrow shaft in a desired horizontal and vertical alignment.

7. The arrow rest of claim 1, wherein said forward one of said opposing end portions has an upwardly open profile to encircle the arrow shaft and wherein said rearward one of said opposing end portions has a downwardly open profile to encircle the arrow shaft when said arm is in the closed position.

8. The arrow rest of claim 1, wherein said opposing end portions of said arm encircle the arrow shaft at a pair of spaced apart points along the length of the arrow shaft.

9. The arrow rest of claim 8, wherein at least one of said opposing end portions of said arm has a profile which encircles at least 180 degrees of the circumference of the arrow shaft.

10. The arrow rest of claim 9, wherein each of said opposing end portions of said arm has a profile which encircles at least 180 degrees of the circumference of the arrow shaft.

11. The arrow rest of claim 1, wherein said arm is rotatable approximately 90 degrees or less from the open position to the closed position.

12. The arrow rest of claim 11, wherein said arm is rotatable approximately 90 degrees from the open position to the closed position.

13. The arrow rest of claim 1, wherein said two opposing end portions each have profiles which urge the arrow shaft into a desired vertical and horizontal alignment in said closed position.

14. The arrow rest of claim 1, wherein when said arm is in said closed position a forward one of the opposing end portions contacts the shaft while the shaft passes through the profile of a rearward one of the opposing ends portions without the shaft contacting the rearward end portion.

15. An arrow rest for supporting an arrow shaft on an archery bow, comprising:

a base securable to an archery bow;

an arm having a middle portion rotatably mounted to said base and two opposing end portions spaced apart along the length of said arm;

wherein said arm is rotatable from an open position wherein said opposing end portions are disengaged from an arrow shaft, to a closed position wherein said end portions encircle and support the arrow shaft in a desired shooting alignment;

said end portions being rotatable in a plane containing the axis of the supported arrow shaft;

said opposing end portions each defining an open profile, wherein said profiles encircle the arrow shaft with said end portions arranged on opposing sides of the arrow shaft; and, a cocking mechanism which retains the arrow rest in the cocked position prior to a full draw of the bow, wherein upon a full draw of the bow the cocking mechanism causes said arm to rotate from a cocked position to a fully drawn position.

16. The arrow rest of claim 15, wherein when said arm is in said closed position a forward one of the opposing end portions contacts the shaft while the shaft passes through the profile of a rearward one of the opposing ends portions without the shaft contacting the rearward end portion.

17. An arrow rest for supporting an arrow shaft on an archery bow, comprising:

a base securable to an archery bow;

an arm for supporting an arrow shaft with a diameter and an elongate axis, said arm having a middle portion rotatably mounted to said base and two opposing end portions spaced apart along the length of said arm, wherein said arm has a rotational axis aligned perpendicular to the axis of the arrow shaft;

wherein said opposing end portions are aligned to define a path arranged to releasably grasp the diameter of an arrow shaft; and, wherein said arm is rotatable from an open position wherein said opposing end portions are disengaged from the arrow shaft to a horizontal closed position engaging the arrow shaft at a full draw of the bow, and wherein said arm is rotatable to be held in a cocked position between said open position and said horizontal closed position prior to a full draw of the bow.

18. The arrow rest of claim 17, wherein when said arm is in said closed position a forward one of the opposing end portions is arranged below the shaft while a rearward one of the opposing ends portions is arranged above the shaft.

19. The arrow rest of claim 17, comprising a cord extendable between said arrow rest and a cabling arrangement on the bow, wherein upon a full draw of the bow the cord is pulled by the cabling arrangement and causes said arm to rotate from said cocked position to said horizontal closed position.

* * * * *